US011058145B2

(12) United States Patent
Nappi et al.

(10) Patent No.: US 11,058,145 B2
(45) Date of Patent: Jul. 13, 2021

(54) SMOKING ARTICLE HAVING FILTER WITH HOLLOW TUBE SEGMENT

(71) Applicant: PHILIP MORRIS PRODUCTS S.A., Neuchatel (CH)

(72) Inventors: Leonardo Nappi, Vallamand (CH); Yves Jordil, Lausanne (CH)

(73) Assignee: Philip Morris Products S.A., Neuchatel (CH)

( * ) Notice: Subject to any disclaimer, the term of this patent is extended or adjusted under 35 U.S.C. 154(b) by 157 days.

(21) Appl. No.: 16/078,156

(22) PCT Filed: Feb. 22, 2017

(86) PCT No.: PCT/EP2017/054087
§ 371 (c)(1),
(2) Date: Aug. 21, 2018

(87) PCT Pub. No.: WO2017/148773
PCT Pub. Date: Sep. 8, 2017

(65) Prior Publication Data

US 2019/0045838 A1 Feb. 14, 2019

(30) Foreign Application Priority Data

Feb. 29, 2016 (EP) ..... 16157947

(51) Int. Cl.
*A24D 3/04* (2006.01)
*A24D 1/04* (2006.01)
(Continued)

(52) U.S. Cl.
CPC ..... *A24D 3/04* (2013.01); *A24D 1/045* (2013.01); *A24D 3/0291* (2013.01); *A24D 3/063* (2013.01); *A24D 3/10* (2013.01)

(58) Field of Classification Search
CPC ..... A24D 3/04; A24D 3/063; A24D 3/0279; A24D 3/0287; A24D 3/0291; A24D 3/10
(Continued)

(56) References Cited

U.S. PATENT DOCUMENTS 4,507,107 A * 3/1985 Berger ..... A24D 3/0233 156/296
8,066,011 B2 * 11/2011 Clark ..... A24D 3/043 131/331

(Continued)

FOREIGN PATENT DOCUMENTS

EP 2683262 9/2017
JP 2015-524274 8/2015

(Continued)

OTHER PUBLICATIONS

European Extended Search Report for Application No. 16157947.9 dated Aug. 17, 2016 (5 pages).

(Continued)

*Primary Examiner* — Michael J Felton
*Assistant Examiner* — Taryn Trace Willett
(74) *Attorney, Agent, or Firm* — Mueting Raasch Group

(57) ABSTRACT

A smoking article (10) comprises: a tobacco rod (12); a filter (14) in axial alignment with the tobacco rod, the filter (14) comprising: a hollow tube segment (22) having a wall thickness of no more than 0.9 mm; and a filtration portion upstream of the hollow tube segment (22), the filtration portion comprising one or more filter segments (18) (20). The hollow tube segment (22) defines a cavity (26) at the mouth end of the filter (14) providing an unrestricted flow channel that extends from the downstream end of the filtration portion to the mouth end of the filter (14). The hollow tube segment (22) is formed from a fibrous filtration material and comprises a filter plasticiser, wherein the (Continued)

amount of filter plasticiser is at least 22 percent by weight of the fibrous filtration material.

15 Claims, 2 Drawing Sheets

(51) Int. Cl.
*A24D 3/02* (2006.01)
*A24D 3/06* (2006.01)
*A24D 3/10* (2006.01)

(58) Field of Classification Search
USPC ..... 131/332, 338, 339, 340, 343, 345; 493/49, 50, 42
See application file for complete search history.

(56) References Cited

U.S. PATENT DOCUMENTS

2012/0291792 A1* 11/2012 Treadaway ..... A24D 3/0225 131/276
2014/0224268 A1 8/2014 Ryter

FOREIGN PATENT DOCUMENTS

| | | |
|---|---|---|
| RU | 2607547 | 10/2015 |
| WO | WO 00/00047 | 1/2000 |
| WO | WO 2011/058319 | 5/2011 |
| WO | WO 2014/023557 | 2/2014 |
| WO | WO 2014/049118 | 4/2014 |
| WO | WO 2014/198815 | 12/2014 |
| WO | WO 2015/181354 | 12/2015 |
| WO | WO 2016/156223 | 10/2016 |

OTHER PUBLICATIONS

PCT Search Report and Written Opinion for PCT/EP2017/054087 dated May 9, 2017 (7 pages).
Office Action issued in Russia for Application No. 2018134192 dated Mar. 17, 2020 (15 pages). English translation included.
Office Action issued in Kazakhstan for Application No. 2018/0654.1 dated Oct. 30, 2019 (8 pages). English translation included.
Office Action issued in Japan for Application No. 2018-541281 dated Feb. 1, 2021 (10 pages). English translation included.

* cited by examiner

SMOKING ARTICLE HAVING FILTER WITH HOLLOW TUBE SEGMENT

This application is a U.S. National Stage Application of International Application No. PCT/EP2017/054087 filed Feb. 22, 2017, which was published in English on Sep. 8, 2017, as International Publication No. WO 2017/148773 A1. International Application No. PCT/EP2017/054087 claims priority to European Application No. 16157947.9 filed Feb. 29, 2016.

The present invention relates to a smoking article having a mouth end cavity defined by a hollow tube segment.

Filter cigarettes typically comprise a cylindrical rod of tobacco cut filler surrounded by a paper wrapper and a cylindrical filter axially aligned in an abutting end-to-end relationship with the wrapped tobacco rod. The cylindrical filter typically comprises a filtration material circumscribed by a paper plug wrap. Conventionally, the wrapped tobacco rod and the filter are joined by a band of tipping wrapper, normally formed of an opaque paper material that circumscribes the entire length of the filter and an adjacent portion of the wrapped tobacco rod. Smoking articles having a cavity at the mouth end of their filter section have also been proposed.

A number of smoking articles in which tobacco is heated rather than combusted have also been proposed in the art. In heated smoking articles, an aerosol is generated by heating an aerosol generating substrate, such as tobacco. Known heated smoking articles include, for example, smoking articles in which an aerosol is generated by electrical heating or by the transfer of heat from a combustible fuel element or heat source to an aerosol forming substrate. During smoking, volatile compounds are released from the aerosol forming substrate by heat transfer from the heat source and entrained in air drawn through the smoking article. As the released compounds cool they condense to form an aerosol that is inhaled by the consumer. Also known are smoking articles in which a nicotine-containing aerosol is generated from a tobacco material, tobacco extract or other nicotine source, without combustion and in some cases without heating, for example through a chemical reaction.

As noted above, in some cases, a smoking article may have a cavity at the mouth end of the filter. Such mouth end cavities are typically formed by extending the plug wrap, the tipping paper, or both the plug wrap and the tipping paper of the filter beyond the most downstream segment of filtration material. However, typical plug wraps may not provide sufficient strength, in particular when the length of the mouth end cavity is increased. There is therefore a risk of deformation of such mouth end cavities. Furthermore, the strength of the plug wrap of the filter will significantly decrease as it becomes wet due to absorption of moisture during smoking, thereby increasing the risk of deformation still further.

It has been previously proposed to incorporate a hollow paper or cardboard tube to define the mouth end cavity. Whilst increasing the rigidity of the mouth end of the filter prior to smoking, this does not overcome the problem of the increased risk of deformation of the mouth end cavity as the materials defining the cavity become wet during smoking. As with the plug wrap, the strength of the paper tube will significantly decrease as the paper tube absorbs moisture during smoking and the paper tube will therefore have an increased tendency to collapse.

It would therefore be desirable to provide a smoking article with a mouth end cavity structure which has an improved moisture resistance and therefore an increased resistance to deformation during smoking. At the same time, it would be desirable to provide such a filtered smoking article that could be manufactured using standard high speed apparatus and techniques, without the requirement for significant changes to existing machines and methods. Furthermore, it would be desirable to provide such a filtered smoking article, without undesirably altering the general smoking experience for a consumer.

According to the invention there is provided a smoking article comprising: a tobacco rod; a filter in axial alignment with the tobacco rod, the filter comprising: a hollow tube segment having a wall thickness of no more than 0.9 mm; and a filtration portion upstream of the hollow tube segment, the filtration portion comprising one or more filter segments. The hollow tube segment defines a cavity at the mouth end of the filter providing an unrestricted flow channel that extends from the downstream end of the filtration portion to the mouth end of the filter. The hollow tube segment is formed from a fibrous filtration material and comprises a filter plasticiser, wherein the amount of filter plasticiser is at least 22 percent by weight of the fibrous filtration material.

According to the invention there is further provided a filter for a smoking article, the filter comprising a hollow tube segment having a wall thickness of no more than 0.9 mm; and a filtration portion upstream of the hollow tube segment, the filtration portion comprising one or more filter segments. The hollow tube segment defines a cavity at the mouth end of the filter providing an unrestricted flow channel that extends from the downstream end of the filtration portion to the mouth end of the filter. The hollow tube segment is formed from a fibrous filtration material and comprises a filter plasticiser, wherein the amount of filter plasticiser is at least 22 percent by weight of the fibrous filtration material.

As used herein, the terms "upstream" and "downstream" are used to describe the relative positions of elements, or portions of elements, of the smoking article in relation to the direction in which a consumer draws on the smoking article during use thereof. Smoking articles as described herein comprise a downstream end and an opposed upstream end. In use, a consumer draws on the downstream end of the smoking article. The downstream end, which is also described as the mouth end, is downstream of the upstream end, which may also be described as the distal end. The "downstream end" of filters according to the invention corresponds to the end of the filter that will form the mouth end of the filter in the assembled smoking article.

The expression "unrestricted flow" is used throughout this specification to indicate that the hollow tube segment internally defines a channel having a substantially constant cross-sectional area for the smoke and air to flow through. Further, the expression "unrestricted flow channel" is used throughout this specification to indicate that the hollow tube segment does not contain any object which may cause a local restriction of the flow of the smoke and air. In other words, the hollow tube segment is empty. Thus, the cross-sectional area available for the smoke and air to flow through is substantially constant along the whole length of the hollow tube segment and flow of smoke and air through the hollow tube segment is substantially unobstructed.

The unrestricted, hollow tube segment does not substantially contribute to increasing the resistance to draw (RTD) of the smoking article. At most, the unrestricted, hollow tube segment contributes only marginally to increasing the RTD of the smoking article. In practice, the unrestricted, hollow tube segment may be adapted to generate a RTD in the range of approximately 1 mm $H_2O$ (about 10 Pa) and approximately 20 mm $H_2O$ (about 200 Pa). Preferably, the unrestricted, hollow tube segment is adapted to generate a RTD between approximately 2 mm $H_2O$ (about 20 Pa) and approximately 10 mm $H_2O$ (about 100 Pa).

As used herein, the term "resistance to draw" refers to the pressure required to force air through the full length of the object under test at the rate of 17.5 millilitres per second at 22 degrees Celsius and 101 kilopascals (760 Torr). Resistance to draw is expressed in units of millimetres water gauge (mm $H_2O$) and is measured in accordance with ISO 6565:2011.

In smoking articles according to the present invention, a mouth end cavity is defined in the filter by a hollow tube segment comprising a combination of a fibrous filtration material with a plasticiser at a level that is significantly elevated compared with a conventional filter tow. This provides a rigid mouth end cavity structure, with an improved moisture resistance such that the mouth end cavity substantially retains its rigidity when the filter is wetted during smoking, thereby minimising the risk of deformation of the mouth end cavity.

The use of a relatively rigid hollow tube segment that substantially retains its rigidity during smoking also enables a filter to be provided with a relatively long mouth end cavity, without greatly increasing the risk of the mouth end cavity being vulnerable to deformation.

In the smoking articles of the present invention, the hollow tube segment can achieve a desired rigidity and moisture resistance whilst providing a relatively low wall thickness of 0.9 mm or less. This advantageously minimises the visual impact of the hollow tube segment as well as minimising the effect of the hollow tube segment on the flow of smoke through the filter.

The hollow tube segment of smoking article of the present invention is formed as an annular segment of a fibrous filtration material which has been combined with a plasticiser. The fibrous filtration material incorporating the plasticiser is compressed to provide a wall thickness of no more than about 0.9 mm, preferably no more than about 0.8 mm, more preferably no more than about 0.6 mm.

Preferably, the wall thickness of the hollow tube segment is at least about 0.3 mm.

The "wall thickness" of the hollow tube segment corresponds to the thickness of the wall in a radial direction. This may be measured, for example, using a calliper. Preferably, the wall thickness is substantially constant around the entire wall of the hollow tube segment. However, where the wall thickness is not substantially constant, the wall thickness is preferably no more than 0.9 mm at any point around the hollow tube segment.

Preferably, the density of the fibrous filtration material in the hollow tube segment is at least about 0.6 grams per cubic centimetre, more preferably at least about 0.7 grams per cubic centimetre, more preferably at least about 0.8 grams per cubic centimetre. For the purposes of the present invention, the "density" of the fibrous filtration material refers to the density of the fibrous filtration material with the plasticiser incorporated. The density may be determined by dividing the total weight of the hollow tube segment by the total volume of the hollow tube segment, wherein the total volume can be calculated using appropriate measurements of the hollow tube segment taken, for example, using callipers. Where necessary, the appropriate dimensions may be measured using a microscope.

The density of the fibrous filtration material may be increased through the compression of the fibrous filtration material during production of the hollow tube segment. Providing an increased density compared to conventional fibrous filtration segments advantageously enables the desired rigidity and moisture resistance to be achieved whilst further reducing the wall thickness.

Preferably, the length of the hollow tube segment is at least about 25 percent of the overall filter length, more preferably at least about 30 percent of the overall filter length, more preferably at least about 40 percent of the overall filter length, more preferably at least about 50 percent of the overall filter length. As discussed above, the improved properties of the hollow tube segment and the improved resistance to moisture enables a relatively long mouth end cavity to be formed in the filter. The expression "overall filter length" is used throughout this specification to refer to the sum of the length of the various components forming the filter.

Preferably, the length of the hollow tube segment is less than about 80 percent of the overall filter length, more preferably less than about 70 percent. Thus, the length of the filtration portion upstream of the hollow tube segment shall account for at least about 20 percent of the overall filter length.

Preferably, the length of the hollow tube segment is less than about 30 mm. More preferably, the length of the hollow tube segment is less than about 20 mm. Still more preferably, the length of the hollow tube segment is less than about 15 mm. In addition, or as an alternative, the length of the hollow tube segment is at least about 8 mm. Preferably, the length of the hollow tube segment is at least about 10 mm. In some preferred embodiments, the length of the hollow tube segment is from about 8 mm to about 30 mm, more preferably from about 10 mm to about 20 mm, even more preferably from about 10 to about 15 mm, most preferably about 10 mm. This not only provides a mouth end cavity and an unrestricted flow channel of an appropriate size, but also ensures sufficient overlap between the hollow tube segment and any wrapper which may circumscribe the hollow tube segment to maintain it in axial alignment with the filter segment or with the tobacco rod or with both. Such wrappers include plug wraps and tipping paper bands.

In preferred embodiments, the hollow tube segment has an outer diameter which substantially corresponds to the outer diameter of the filtration portion of the filter. This facilitates the combination and wrapping of the hollow tube segment with the other filter segments and enables manufacture of the filter and smoking article using existing high speed combining machines and processes.

Preferably, the hardness of the filter at the mouth end cavity is at least about 90 percent, more preferably at least about 92 percent and most preferably at least about 94 percent when measured prior to smoking. This corresponds to the "dry hardness" of the filter at the mouth end cavity.

Preferably, the wet hardness of the filter at the mouth end cavity is within about 10 percent of the dry hardness of the filter at the mouth end cavity, as defined above. The "wet hardness" corresponds to the hardness of the filter after the filter has been immersed in water for 5 seconds at a temperature of 22 degrees Centigrade. Most preferably, the wet hardness of the filter at the mouth end cavity is within about 5 percent of the dry hardness of the smoking article at the mouth end cavity. This means that the hardness of the hollow tube segment is substantially unaffected as a result of exposure of the hollow tube segment to moisture. The hollow tube segment can therefore substantially retain its rigidity during smoking, such that the risk of deformation is not significantly affected.

Preferably, the wet hardness of the filter at the mouth end cavity is at least 85 percent, more preferably at least 90 percent. Particularly preferably, both the dry hardness and the wet hardness of the filter at the mouth end cavity are at least about 90 percent.

In contrast, the corresponding wet hardness of a prior art filter having a paper tube defining a mouth end cavity would typically be at least 40 percent lower than the dry hardness, indicating a significant reduction in the rigidity of the mouth end cavity after exposure of the filter to water.

The term "hardness" used throughout this specification denotes the resistance to deform. Hardness is generally expressed as a percentage. FIG. 1 shows a filter 101 before applying a load F and the same filter 103 whilst applying load F. The filter 101 before load F has been applied has a diameter $D_s$. The filter 103 after applying a set load for a set duration (but with the load still applied) has a (reduced) diameter $D_d$. The depression is $d=D_s-D_d$. Referring to FIG. 1, hardness is given by:

$$\text{hardness}(\%) = \frac{D_d}{D_S} * 100\%$$

where $D_s$ is the original (undepressed) filter diameter, and $D_d$ is the depressed diameter after applying a set load for a set duration. The harder the material, the closer the hardness is to 100%.

A test to determine the hardness of a filter may be performed using the standard operating procedure of a Borgwaldt Hardness Tester H10 (manufactured and made commercially available by Heinr Borgwaldt GmbH, Germany).

In certain preferred embodiments, the hollow tube segment has a substantially circular cross-sectional shape. In other preferred embodiments, the hollow tube segment has a non-circular cross-sectional shape, for example, an oval or elliptical cross-sectional shape. In all embodiments, the cross-sectional shape of the smoking article is preferably substantially the same along the full length of the smoking article, including the hollow tube segment.

As described above, the hollow tube segment of smoking articles of the present invention is formed from a fibrous filtration material combined with an elevated level of filter plasticiser.

Suitable fibrous filtration materials for forming the hollow tube segment would be known to the skilled person. Preferably, the hollow tube segment is formed from cellulose acetate tow.

Preferably, the fibrous filtration material of the hollow tube segment comprises fibres of between approximately 3.5 denier per filament (dpf) and approximately 9 dpf, more preferably between approximately 5 denier per filament (dpf) and approximately 8 dpf.

Preferably, the fibrous filtration material of the hollow tube segment comprises fibres of between approximately 25000 total denier (td) and approximately 50000 td, more preferably between 35000 total denier (td) and approximately 50000 td.

Suitable plasticisers for use in the hollow tube segment include but are not limited to triacetin, triethylene glycol di-acetate (TEGDA), ethylene-vinyl acetate, polyvinyl alcohol, starch and combinations thereof.

According to the invention, the hollow tube segment comprises an amount of filter plasticiser corresponding to at least about 22 percent by weight of the fibrous filtration material, more preferably at least about 23 percent by weight of the fibrous filtration material, more preferably at least about 24 percent by weight of the fibrous filtration material.

Preferably, the amount of filter plasticiser is no more than about 30 percent by weight of the fibrous filtration material, more preferably no more than about 28 percent by weight of the fibrous filtration material and most preferably no more than 26 percent by weight of the fibrous filtration material.

Preferably, the amount of filter plasticiser is between about 22 percent and about 30 percent by weight of the fibrous filtration material, more preferably between about 23 percent and about 28 percent by weight of the fibrous filtration material, most preferably between about 24 percent and about 26 percent by weight of the fibrous filtration material.

Preferably, the filter plasticiser is applied to the fibres of filtration material prior to compression of the fibres into an annular form. Suitable apparatus and methods for application of the filter plasticiser to the filter fibres would be known to the skilled person.

Preferably, smoking articles according to the invention comprise a ventilation zone comprising at least one circumferential row of perforations provided at a location around the filtration portion. By providing at least one circumferential row of perforations at a location around the filtration portion, the ventilated introduction of air into the filter will not affect the structure of the mouth end cavity. Mainstream smoke can be diluted upstream of the mouth end cavity and allowed to mix further with air as it passes through the mouth end cavity.

Preferably, the at least one circumferential row of perforations is located at least about 5 mm upstream from the downstream end of the filtration portion. In more preferred embodiments, the at least one circumferential row of perforations is located at least about 8 mm upstream from the downstream end of the filtration portion. This advantageously makes it less likely for the consumer to obstruct the ventilation zone when holding the smoking article with his or her lips or fingers.

In addition, or as an alternative, the at least one circumferential row of perforations is preferably located less than about 12 mm upstream from the downstream end of the filtration portion. More preferably, the at least one circumferential row of perforations is preferably located less than about 10 mm upstream from the downstream end of the filtration portion. This can ensure the at least one circumferential row of perforations is not positioned too close to the tobacco rod.

In addition, or as an alternative, the at least one circumferential row of perforations may be disposed a distance from the mouth end of the filter that is at least about 50 percent of the overall filter length. Preferably, the at least one circumferential row of perforations is disposed a distance from the mouth end of the filter that is at least about 70 percent of the overall filter length.

In some preferred embodiments, the ventilation zone comprises two circumferential rows of perforations provided at a location around the filtration portion. Preferably, each circumferential row of perforations comprises from 8 to 30 perforations.

The filtration portion of the filters of smoking articles according to the invention comprises one or more filter segments upstream of the hollow tube segment.

In preferred embodiments, the filtration portion comprises a first filter segment upstream of the hollow tube segment. Preferably, the length of the first filter segment is at least about 8 mm. In certain preferred embodiments, the length of the first filter segment is at least about 10 mm. Alternatively, or in addition, the length of the first filter segment is less than about 14 mm. In preferred embodiments, the length of the first filter segment is between about 8 mm and about 14 mm, more preferably between about 10 mm and about 14 mm. In certain preferred embodiments, the length of the first filter segment is about 12 mm.

In certain embodiments according to the invention, the length of the hollow tube segment is within 5 mm of the length of the first filter segment. In more preferred embodiments, the length of the hollow tube segment is within 2 mm of the length of the first filter segment. Alternatively, or in addition, in certain embodiments according to the invention, the length of the hollow tube segment is less than the length of the first filter segment.

In certain embodiments according to the invention, the length of the first filter segment is at least about 10 percent of the overall filter length. Preferably the length of the first filter segment is at least about 20 percent of the overall filter length. More preferably, the length of the first filter segment is at least about 30 percent of the overall filter length. Alternatively, or in addition, the length of the first filter segment may be less than about 80 percent of the overall filter length. Preferably, the length of the first filter segment is less than about 60 percent of the overall filter length. More preferably, the length of the first filter segment is less than about 40 percent of the overall filter length.

In certain preferred embodiments, the length of the first filter segment is between about 10 percent and about 80 percent of the overall filter length. In more preferred embodiments, the length of the first filter segment is between about 20 percent and about 60 percent of the overall filter length. In still more preferred embodiments, the length of the first filter segment is between about 30 percent and about 40 percent of the overall filter length.

In certain preferred embodiments of the invention, the combined length of the hollow tube segment and the first filter segment is at least about 35 percent of the overall filter length. Preferably, the combined length of the hollow tube segment and the first filter segment is at least about 50 percent of the overall filter length. More preferably, the combined length of the hollow tube segment and the first filter segment is at least about 70 percent of the overall filter length.

The hollow tube segment and the one or more filter segments of the filtration portion are preferably circumscribed by a band of plug wrap, referred to hereafter as a combining plug wrap. Preferably, the combining plug wrap is impermeable.

Preferably, the combining plug wrap has a basis weight of less than about 120 grams per square metre, preferably less than about 100 grams per square metre, more preferably less than about 90 grams per square metre. In addition, or as an alternative, the combining plug wrap preferably has a basis weight of at least about 70 grams per square metre, preferably at least about 80 grams per square metre. The combining plug wrap may have a basis weight of between about 120 grams per square metre and about 70 grams per square metre, preferably of between about 80 grams per square metre and about 100 grams per square metre. Most preferably, the plug wrap has a basis weight of about 80 grams per square metre. By arranging for the combining plug wrap to have such a relatively high basis weight, the segments of the filter that are upstream of the hollow tube segment may exhibit a firmness that is comparable to the firmness of the filter at the hollow tube segment. This can advantageously give a consumer the perception that the filter has a generally uniform firmness along its length, and therefore make the presence of the hollow tube segment is less noticeable.

Preferably, the combining plug wrap has a thickness of at least about 80 micrometres, more preferably a thickness of at least about 100 micrometres. Preferably, combining plug wrap has a thickness of less than about 180 micrometres, more preferably a thickness of less than about 140 micrometres. By arranging for the combining plug wrap to have such a relatively high thickness, the segments of the filter that are upstream of the hollow tube segment may exhibit a firmness that is comparable to the firmness of the filter at the hollow tube segment. This can advantageously give a consumer the perception that the filter has a generally uniform firmness along its length, and therefore make the presence of the hollow tube segment is less noticeable.

The combining plug wrap may be affixed to the hollow tube segment and one or more filter segments of the filtration portion using, for example, an adhesive. Where the filter comprises a substantially air impermeable combining plug wrap, the filter preferably comprises at least one circumferential row of perforations provided through a portion of the combining plug wrap. By way of example, the perforations through the plug wrap may be formed online during manufacture of the smoking article. Preferably, the circumferential row or rows of perforations provided through a portion of the combining plug wrap are in substantial alignment with a portion of the first filter segment.

The filter comprising the combining plug wrap is preferably attached to the tobacco rod by a band of substantially impermeable tipping paper. The tipping wrapper may comprise paper having a basis weight of less than about 70 grams per square metre, preferably less than about 50 grams per square metre. The tipping wrapper preferably has a basis weight of more than about 20 grams per square metre.

The band of tipping paper may extend over the whole length of the filter and over a portion of the tobacco rod. Thus, the band of tipping paper may overlap ventilation perforations provided at a location around the first filter segment. In such embodiments, the ventilation perforations preferable extend through the band of tipping paper.

As mentioned above, the one or more filter segments of the filtration portion may comprise additional filter segments in combination with the first filter segment. For example, in one embodiment, the smoking article further comprises a rod end segment of filtration material between the first filter segment and the tobacco rod. The filter may include one or more additional filter segments between the first end segment and the rod end segment. However, in preferred embodiments, the rod end segment of filtration material abuts the first filter section. In more preferred embodiments, the rod end segment of filtration material abuts both the first filter segment and the tobacco rod.

Preferably the length of the rod end segment of filtration material is within about 5 mm of the length of the first filter segment. More preferably, the length of the rod end segment of filtration material is within about 1 mm of the length of the first filter segment. In some particularly preferred embodiments, the length of the rod end segment of filtration material is substantially the same as the length of the first filter segment.

In certain preferred embodiments, the length of the rod end segment of filtration material is at least about 20 percent of the overall filter length. More preferably, the length of the rod end segment of filtration material is at least about 30 percent of the overall filter length.

Alternatively, or in addition, the length of the rod end segment of filtration material is less than about 80 percent of the overall filter length. Preferably, the length of the rod end segment of filtration material is less than about 50 percent of the overall filter length.

In certain preferred embodiments, the length of the rod end segment of filtration material is between about 20 percent and about 80 percent of the overall filter length. In more preferred embodiments, the length of the rod end segment of filtration material is between about 30 percent and about 50 percent of the overall filter length.

The filtration material within each filter segment of the smoking article is preferably a plug of fibrous filtration material, such as cellulose acetate tow or paper. A filter plasticiser may be applied to the fibrous filtration material in a conventional manner, by spraying it onto the separated fibres, preferably before applying any additional material to the filtration material. Alternatively, or in addition, smoking articles in accordance with the present invention may include one or more segments containing one or more additives. These additives may include, but are not limited to, flavourants and carbon particles.

Preferably, the rod end segment comprises carbon particles. Preferably, the carbon is activated carbon. In preferred embodiments, the density of carbon particles in the rod end segment is at least about 1 milligram of carbon per millimetre of filtration material. More preferably, the density of carbon particles in the rod end segment is at least about 5 milligrams of carbon per millimetre of filtration material. The density of carbon particles in the rod end segment may not be greater than about 15 milligrams of carbon per millimetre of filtration material, preferably not greater than 10 milligrams of carbon per millimetre of filtration material.

The density of carbon particles in the rod end segment may be between about 1 milligram of carbon per millimetre of filtration material and about 15 milligrams of carbon per millimetre of filtration material, preferably between about 5 milligrams of carbon per millimetre of filtration material and about 10 milligrams of carbon per millimetre of filtration material.

In some embodiments, it may be desirable to provide the filter with means for releasing a flavourant or other additive on demand, usually via manual release by the consumer immediately prior to smoking the article. Therefore, the filter may comprise at least one filter segment including a flavourant containing material, such as, for example, one or more breakable capsules comprising an outer shell and an inner core containing an additive. Preferably the at least one filter segment comprises one or more breakable capsules dispersed within a fibrous filtration material. The at least one filter segment may be the first filter segment, or an additional filter segment which may be incorporated into the filter, or a combination thereof.

In embodiments comprising a flavourant containing material, the at least one flavour containing filter segment is preferably circumscribed by a plug wrap that is substantially impermeable to the flavourant additive. This advantageously inhibits transfer of the additive through the plug wrap to the outside of the smoking article, where it may undesirably come into contact with the consumer's fingers and may tarnish the appearance of the smoking article.

The tobacco rod may comprise any suitable type or types of tobacco material or tobacco substitute, in any suitable form.

The invention will be further described, by way of example only, with reference to the accompanying drawings in which.

Figure 1:
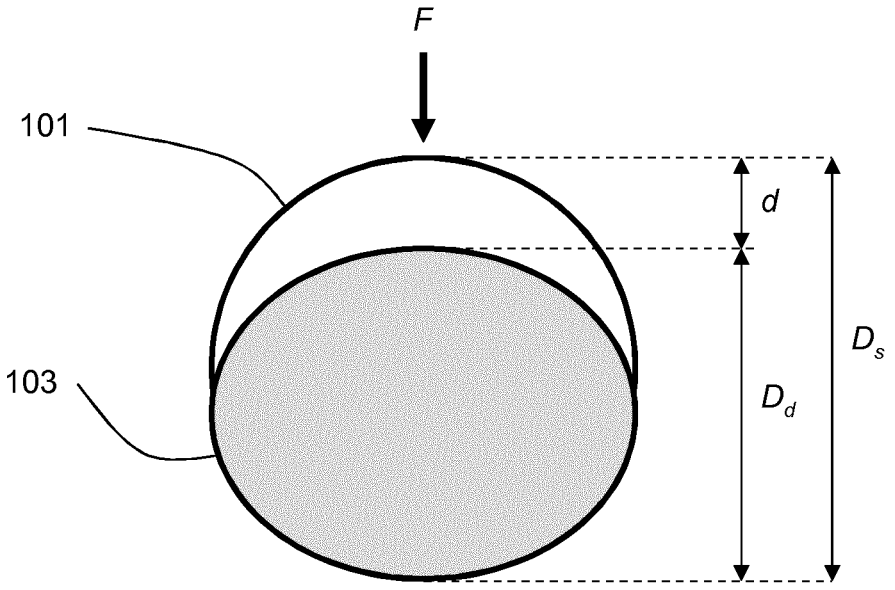
FIG. 1 illustrates the definition of hardness, as discussed above.
Figure 2:
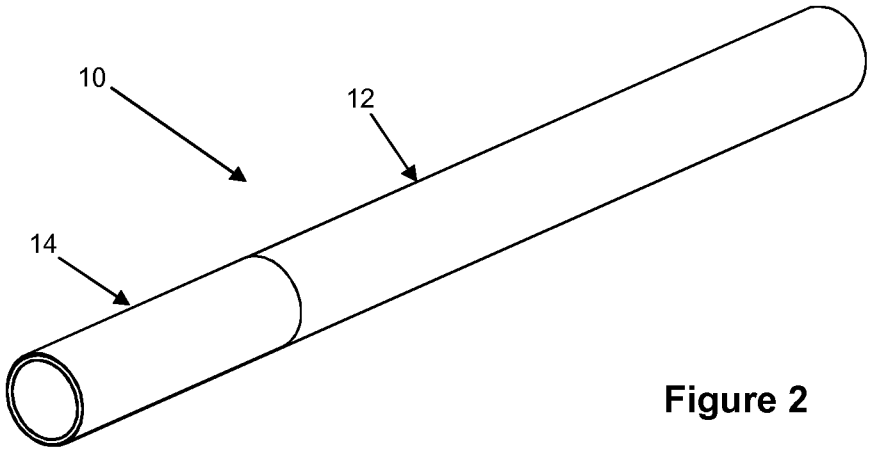
FIG. 2 shows a smoking article in accordance with the invention.
Figure 3:
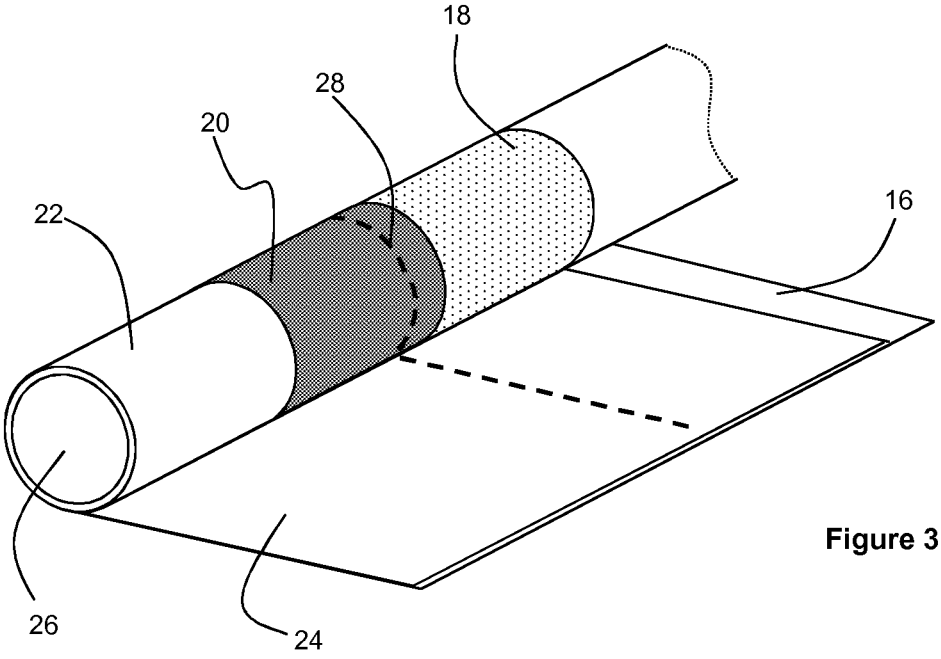
FIG. 3 shows the smoking article of FIG. 2 in an unwrapped condition.

FIGS. 2 and 3 illustrate a smoking article 10 in accordance with the present invention. The smoking article 10 comprises a wrapped rod 12 of tobacco cut filler which is attached at one end to an axially aligned filter 14. A band of tipping paper 16 circumscribes the filter 14 and a portion of the wrapped rod 12 of tobacco to join together the two portions of the smoking article 10.

As shown in FIG. 3, the filter 14 comprises a hollow tube segment 24, a first filter segment 20, which may or may not contain flavour, and a rod end filter segment 18. The upstream end of the hollow tube segment 22 abuts the downstream end of the first filter segment 20. The upstream end of the first filter segment 20 abuts the downstream end of the rod end filter segment 18. The upstream end of the rod end filter segment 18 abuts the tobacco rod 12. The hollow tube segment is 10 mm long. The first filter segment is 12 mm long. The rod end filter segment is 12 mm long. The overall filter length is 34 mm.

The hollow tube segment 22 and the filter segments 20 and 18 are circumscribed by a band of combining plug wrap 24 which connects the three segments to form the filter 14. One or more of the segments 18, 20, 22 may additionally be wrapped in an individual plug wrap.

The first filter segment 20 and the rod end filter segment 18 are formed of a suitable filtration material, such as cellulose acetate tow. Furthermore, the first filter segment 20 may comprise a suitable flavourant, which may be provided in the form of one or more breakable capsules contained within the first filter segment 20. In this case, the one or more breakable capsules are ruptured by the consumer when desired by squeezing the first filter segment 20 between the consumer's fingers. The rod end filter segment 18 contains an adsorbent material, such as a carbon-based adsorbent material.

The hollow tube segment 22 defines a mouth end cavity 26 in the filter 14 and provides an unrestricted flow channel which extends between the downstream end of the first filter segment 20 and the mouth end of the filter 14. In more detail, the hollow tube segment 22 internally defines a channel having a substantially constant cross-sectional area for the smoke and air to flow through. Further, the hollow tube segment 22 does not contain any object adapted to cause a local restriction of the flow of the smoke and air. Thus, the cross-sectional area available for the smoke and air to flow through is substantially constant along the whole length of the hollow tube segment 22 and flow of smoke and air through the hollow tube segment 22 is unobstructed.

The hollow tube segment 22 is an annular segment formed from cellulose acetate tow with a triacetin plasticiser. The amount of triacetin in the cellulose acetate tow corresponds to between 22 percent and 26 percent by weight of the cellulose acetate tow. The hollow tube segment has a wall thickness of 0.6 mm and a density of approximately 1 gram per cubic centimetre.

The filter 14 has a dry hardness at the mouth end of approximately 96 percent and a wet hardness of approximately 92 percent, when measured according to the hardness test procedure set out above. These hardness measurements demonstrate that the hollow tube segment 22 has a very high resistance to moisture so that the rigidity of the hollow tube segment is substantially retained when the filter is wetted.

The resistance to deformation of the mouth end cavity 24 is therefore substantially retained during smoking of the smoking article 10.

The smoking article 10 further comprises a ventilation zone 28 at a location along the first filter segment 20. In more detail, the ventilation zone 28 comprises a row of perforations extending through the first filter segment 20. The row of perforations is located 10 mm upstream of the downstream end of the first filter segment. A row of perforations also extend through the band of combining plug wrap 24 and through the band of tipping paper 16. The row of perforations extending through the band of combining plug wrap 24 and through the band of tipping paper 16 are substantially aligned with those extending through the first filter segment 20.

The invention claimed is:

1. A smoking article comprising:

a tobacco rod;

a filter in axial alignment with the tobacco rod, the filter comprising:

a hollow tube segment having a wall thickness of no more than 0.9 mm; and a filtration portion upstream of the hollow tube segment, the filtration portion comprising one or more filter segments;

wherein the hollow tube segment defines a cavity at the mouth end of the filter providing an unrestricted flow channel that extends from the downstream end of the filtration portion to the mouth end of the filter; and wherein the hollow tube segment is formed from a fibrous filtration material and comprises a filter plasticiser, wherein the amount of filter plasticiser is at least 22 percent by weight of the fibrous filtration material.

2. The smoking article according to claim 1 wherein the hollow tube segment has a wall thickness of no more than 0.6 mm.

3. The smoking article according to claim 1 wherein the hollow tube segment has a wall thickness of at least 0.3 mm.

4. The smoking article according to claim 1 wherein the density of the fibrous filtration material in the hollow tube segment is at least 0.6 grams per cubic centimetre.

5. The smoking article according to claim 4 wherein the density of the fibrous filtration material in the hollow tube segment is at least 0.8 grams per cubic centimetre.

6. The smoking article according to claim 1 wherein the fibrous filtration material forming the hollow tube segment is cellulose acetate.

7. The smoking article according to claim 1 wherein the fibrous filtration material comprises fibres of between 3.5 denier per filament and 9 denier per filament.

8. The smoking article according to claim 1 wherein the fibrous filtration material comprises fibres of between 25000 total denier and 50000 total denier.

9. The smoking article according to claim 1 wherein the filter plasticiser is selected from triacetin, triethylene glycol diacetate (TEGDA), ethylene vinyl acetate, polyvinyl alcohol, starch or combinations thereof.

10. The smoking article according to claim 1 wherein the amount of filter plasticiser is no greater than 30 percent by weight of the fibrous filtration material.

11. The smoking article according to claim 1 wherein the length of the hollow tube segment is at least about 25 percent of the overall filter length.

12. The smoking article according to claim 1 wherein the wet hardness of the filter at the mouth end cavity is within 10 percent of the dry hardness of the filter at the mouth end cavity.

13. The smoking article according to claim 1 wherein the wet hardness of the filter at the mouth end cavity is at least 90 percent.

14. The smoking article according to claim 1 wherein the filter comprises a ventilation zone comprising at least one circumferential row of perforations provided at a location around the filtration portion.

15. A filter for a smoking article, the filter comprising:

a hollow tube segment having a wall thickness of no more than 0.9 mm; and a filtration portion upstream of the hollow tube segment, the filtration portion comprising one or more filter segments;

wherein the hollow tube segment defines a cavity at the mouth end of the filter providing an unrestricted flow channel that extends from the downstream end of the filtration portion to the mouth end of the filter; and wherein the hollow tube segment is formed from a fibrous filtration material and comprises a filter plasticiser, wherein the amount of filter plasticiser is at least 22 percent by weight of the fibrous filtration material.

* * * * *